US006526944B1

(12) United States Patent
Hlousek

(10) Patent No.: US 6,526,944 B1
(45) Date of Patent: Mar. 4, 2003

(54) ENERGY ACCUMULATOR-SUPPORTED CONTROL OF THE INJECTION QUANTITIES IN LARGE DIESEL ENGINES

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,882

(22) PCT Filed: Nov. 8, 2000

(86) PCT No.: PCT/DE00/03899

§ 371 (c)(1),
(2), (4) Date: Dec. 17, 2001

(87) PCT Pub. No.: WO01/34957

PCT Pub. Date: May 17, 2001

(30) Foreign Application Priority Data

Nov. 10, 1999 (DE) ..... 199 54 058

(51) Int. Cl.[7] ..... F02M 37/04

(52) U.S. Cl. ..... 123/458; 123/506; 251/129.09

(58) Field of Search ..... 123/458, 506, 123/457, 447, 467; 251/129.09, 129.1

(56) References Cited

U.S. PATENT DOCUMENTS

| | | | | | |
|---|---|---|---|---|---|
| 4,619,239 | A | * | 10/1986 | Wallenfang | 123/506 |
| 5,295,469 | A | * | 3/1994 | Kariya et al. | 123/456 |
| 5,518,030 | A | * | 5/1996 | Liu | 123/506 |
| 5,884,606 | A | * | 3/1999 | Kelher | 123/506 |
| 5,983,863 | A | * | 11/1999 | Cavanagh et al. | 123/447 |
| 6,076,504 | A | * | 6/2000 | Stavnheim et al. | 123/447 |
| 6,293,251 | B1 | * | 9/2001 | Hemmerlein et al. | 123/447 |

* cited by examiner

*Primary Examiner*—Carl S. Miller
(74) *Attorney, Agent, or Firm*—Ronald E. Greigg

(57) ABSTRACT

The invention relates to a control unit for an injection system for fuel, having a control part movable between a valve seat and a stop face of a bore in the housing. A high-pressure line discharges into a bore that penetrates the housing and receives the control part. A control face of the control part opposite the valve seat acts in the higher rpm range as a throttle element for filling a pump chamber in the housing.

8 Claims, 1 Drawing Sheet

ENERGY ACCUMULATOR-SUPPORTED CONTROL OF THE INJECTION QUANTITIES IN LARGE DIESEL ENGINES

CROSS-REFERENCE TO RELATED APPLICATIONS

This application is a 35 USC 371 application of PCT/DE 00/03899 filed on Nov. 8, 2000.

BACKGROUND OF THE INVENTION

1. Field of the Invention

The invention relates to the industrial field of controlling fuel quantities in large diesel engine applications, in which longer valve strokes at higher flow cross sections are required on the one hand and smaller injection quantities at high rpm are required on the other.

2. Description of the Prior Art

From the prior art, fast-switching valves in which fast-switching magnets are provided are known for passenger car and truck applications. The switching times attainable with fast-switching magnets can be attained especially in applications in which small flow cross sections for the fuel are needed and the valve strokes are in particular shorter than about 0.3 mm. In large diesel engines, which are used in maritime applications for instance or in armored vehicles for military purposes, longer valve strokes must be achieved, since the fuel quantities required are greater. At longer valve strokes and high fuel quantities, however, the advantages of shorter switching times that are attainable with electrically triggerable magnets vanish, since the magnets are capable of bringing only limited closing forces to bear, forces that are exceeded in large diesel engine applications. On the other hand, for applications in large diesel engines, 2/2-way valves are of only limited use. These larger-sized 2/2-way valves furnish the larger injection quantities required at lower rpm and also bring the requisite high closing forces to bear on the control edges of the control slide. On the other hand, the switching times of such large-sized 2/2-way valves are longer, since the masses in motion on the valve, armature plate and closing body entail greater forces of inertia. Furthermore, the valve strokes are longer, which makes the switching times longer as well.

In the higher rpm range, large diesel engines require smaller metered fuel quantities, which can be achieved only with difficulty with sluggish 2/2-way valves, because of their longer switching times. Fast-switching magnet valves, conversely, do not bring to bear the requisite high closing forces for sealing off the control edges; on the other hand, with this type of valve, smaller fuel quantities can indeed be attained.

SUMMARY OF THE INVENTION

With a valve according to the invention, the advantages of longer stroke paths and longer switching times at higher flow cross sections of the 2/2-way valve can advantageously be combined with the shorter switching times attainable with magnet valves and smaller metered fuel quantities at higher rpm. With the control unit, the two actuating devices that trip the adjusting motion of the control part can be triggered individually and make it possible for the suction chamber surrounding the control part to enter into communication with a pump chamber acting as a reservoir, or for the pump chamber to be disconnected from the high-pressure line By making the diameter of the cylinder and the closing body different in the control part embodied movably in the housing, it is possible by means of the pressure acting on the larger diameter of the closing body in cooperation with the energy accumulator on the return side, to achieve a defined end of pumping out of the pump chamber, which pump chamber can be made to communicate with the high-pressure line again by means of impact of the closing body with the stop assigned to it in the bore in the housing.

In the control part, there is a through bore which via openings in the control part communicates with respective hollow chambers that receive the energy accumulators. The through bore carries excess fuel back to the fuel tank via the return line; an overflow line is assigned to the suction chamber surrounding the control part in the housing of the control unit, and at high system pressures that occur, this overflow line—protected by a check valve disposed upstream of the tank—protects the control unit from damage.

BRIEF DESCRIPTION OF THE DRAWING

Other features of the invention will be described in detail in conjunction with the single drawing FIGURE which shows the cross section through one embodiment according to the invention of the 2/2- way valve for large diesel engine applications, which in the housing surrounding it is triggered by two energy accumulator-reinforced actuating devices.

DESCRIPTION OF THE PREFERRED EMBODIMENT

Figure 1:
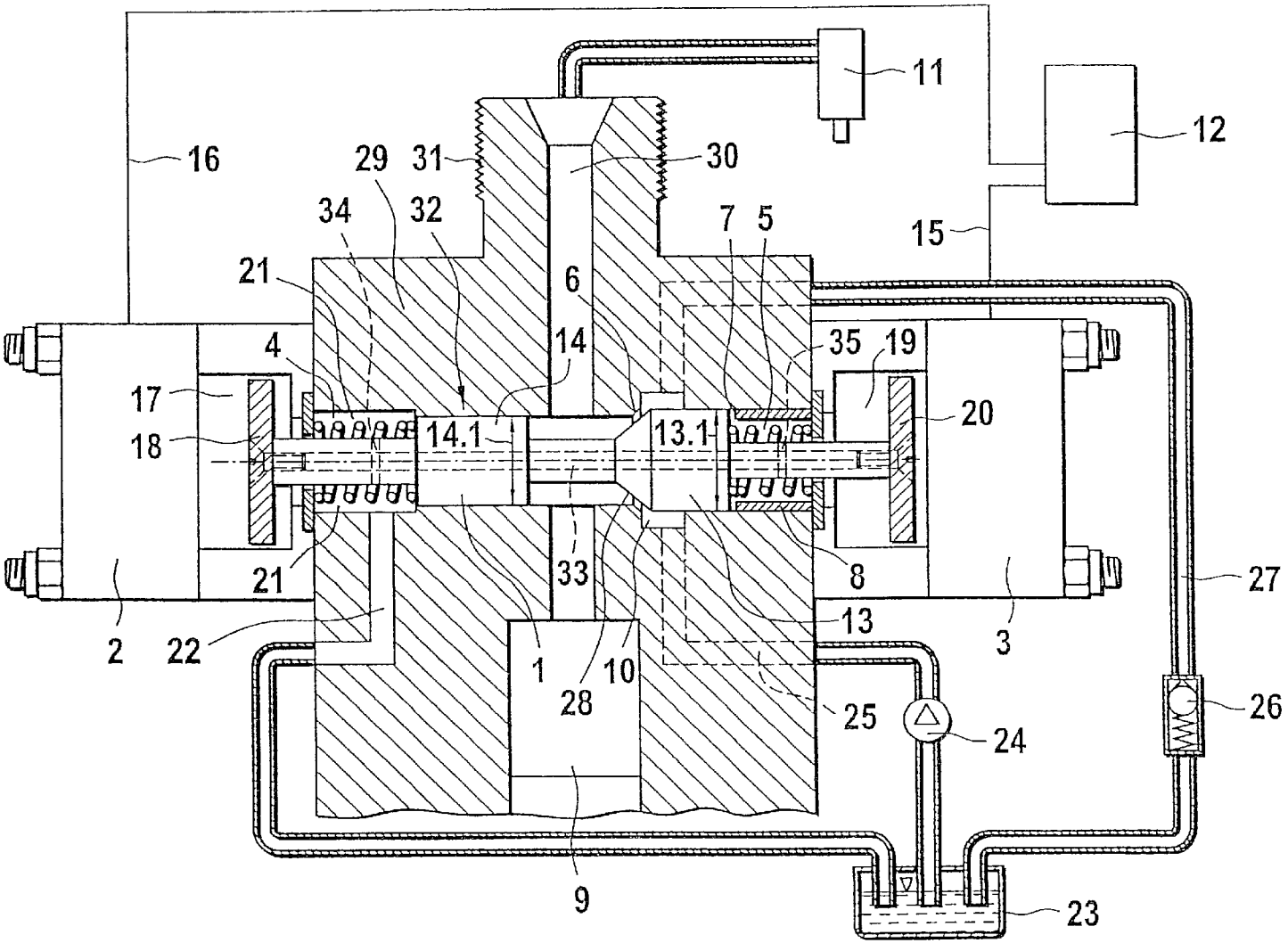

In the illustrated embodiment, proposed according to the invention, of the control unit in the form of a 2/2-way valve, actuating devices 2 and 3 on the respective ends of the control part 1 are assigned to the housing 29 that surrounds the control part 1. These actuating devices 2, 3 are preferably embodied as magnet elements, each triggerable individually via a control unit 12, the individual triggering being effected by way of the two control lines 15 and 16.

The control housing 29 of the 2/2-way valve is embodied as a complete unit, which is penetrated by a housing bore 32. A control valve, preferably embodied as a control slide, is let into the housing bore 32. The housing 29 can be made from inexpensive material, while the control part 1 itself is of high-quality material. The two fitting faces of the housing bore 32 of the housing 29 and the outer face of the control part 1 are produced to close tolerances, so that the overflow leakage losses in the relative motion of the control part 1 in the housing bore 32 remain limited to a minimum. A bore 30 which connects the housing bore 32 to an injection nozzle 11 is also let into the housing 29 of the 2/2-way valve. For the sake of simplicity, only one injection nozzle 1 is shown here. A pump chamber 9 is also provided in the housing 29 and likewise communicates with the housing bore 32 that penetrates the housing 29. Flanges, which form respective hollow chambers 17 and 19 when actuating elements 2, 3 are braced against the flanges, are mounted laterally on the housing 29 of the 2/2-way valve. Armature plates 18 and 20 are received in the two hollow chambers 17 and 19, respectively, and cooperate with the actuating devices 2, 3, embodied preferably as electromagnets. The armature plates 18 and 20 are screwed to the ends of the control part 1, and the screws seal off a through bore 33 in the control part 1 toward both ends.

A suction chamber 10 is also embodied on the housing bore 32 and annularly widens one region of the housing bore 32. A high-pressure line 25 discharges into the annularly embodied suction chamber 10. The fuel pumped out of the tank 23 by a high-pressure pump 24 is present in the high-pressure line 25, so that after the suction chamber 10 has been uncovered by the closing body 13, it can flow into the pump chamber 9 or the bore 30 in the housing 29. The suction chamber 10 also communicates with an overflow line 27, which discharges, protected by a check valve 26, into the tank 23. By means of the overflow line 27, the 2/2-way valve can be secured against damage in the event of pressure surges by a tripping pressure that is adjustable in the check valve 26.

A pressureless return line 22 is also embodied in the housing 29 of the 2/2-way valve, and by way of this return line excess fuel can flow back into the tank 23 and from there can be pumped back into the high-pressure line 25 via the high-pressure pump 24.

In the end regions of the housing bore 32, recesses of somewhat increased diameter are provided, which each receive one energy accumulator 4, 5, preferably in the form of a helical spring. The energy accumulators 4, 5 are braced on one end on the housing 29 of the 2/2-way valve and, on the other end, rest on the annular faces of a cylinder 14 and a closing body 13 that are embodied on the control part 1. The cylinder 14 is embodied with a somewhat smaller diameter 14.1, compared with the diameter 13.1 of the closing body 13. The closing body 13 encloses an adjusting face 28, which cooperates with a valve seat 6 that is provided on the housing 29. The control face 28 is preferably embodied as a conical face, tapering toward the pressureless return 22, on the control part 1, for instance being embodied as a cone or a truncated cone.

The stroke travel of the cylinder having the frustoconical end 28 and serving as a closing body 13 is defined on one end by the valve seat 6 on the housing 29 of the 2/2-way valve and on the other by the stop 7 of a sleeve 8 let into the housing bore 32. Between the stops 6 and 7, the adjusting travel can be adjusted, which in large diesel engine applications is longer than 0.3 mm.

The control part 1 is penetrated by a through bore 33, which is sealed off by the respective screws that secure the armature plates 18 and 20 to the ends of the control part 1. The through bore 33 communicates via respective openings 34, 35 with the hollow chambers that each accommodate the respective energy accumulators 4, 5. Outflowing fuel flows via the fitting gap between the closing body 13 and the housing bore 32 into the hollow chamber that extends around the energy accumulator 5. Via the opening 35 and the through bore 33, the fuel flows into the hollow chamber surrounding the energy accumulator 4 on the return side, from which chamber the return 22 discharges into the tank 23 and into which chamber the fuel can flow back.

The mode of operation of the 2/2-way valve can be described as follows. The energy accumulators 4, 5 are dimensioned such that when there is no current to the magnets 2, 3, the closing body 13 remains in its opened position. At low rpm, no injection takes place; at higher rpm and without current to the magnets 2, 3, the filling of the pump chamber 9 with fuel that is at high pressure is so impaired by the throttling action established because of the annular gap formed between the valve seat 6 and the switching face 28, that only very small quantities or no fuel at all is pumped to the injection nozzle 11.

In normal operation of the 2/2-way valve, conversely, current is supplied by the control unit 12 via the control line 15 to magnet 3, so that the control part 1 is moved to the stop 7 and prestresses the energy accumulator 5. As a result, the annular gap between valve seat 6 and the control face 28 is uncovered; the pump chamber 9 fills with fuel which is at high pressure. At the onset of pump feeding, the supply of current to the magnet 3 via the control line 15 by the control unit 12 is ended, while the magnet 2 on the return side of the control part 1 is supplied with current. The reversal of current delivery is completed within a period of approximately 1 ms.

The relaxation of the energy accumulator 5 reinforces the closure of the annular gap between the valve seat 6 and the control face 28, so that even at stroke travel paths that are longer than 0.3 mm, as is the rule in large diesel engine applications, a faster closing motion ensues. Thus even relatively long stroke travel paths at higher rpm can be traversed within the briefest possible time and can effectively bring the requisite closing forces to bear.

If conversely, the magnet 3 is again supplied with current by the control unit 12—at the end of feeding, for instance—then the magnet 2 is deactivated. By the energy accumulator 4 and the hydraulic force counter to the energy accumulator 5, the closing body 13 moves against the stop 7 of the sleeve 8 let into the housing bore 32. This driving motion is reinforced still further by the fact that the diameter 13.1 of the closing body 13 is dimensioned somewhat larger than the diameter 14.1 of the cylinder 14 on the control part 1. As a result, forces that in total exceed the force of the energy accumulator 5 ensue.

The opening and closure of the control part 1 can be detected by the control unit 12 by means of analysis of the control current or control voltage. Thus without additional components, a simple functional diagnosis can be performed; furthermore, the injection onset can be assigned exactly to top dead center of the cylinder of an internal combustion engine. The injection quantity can be effectively determined in advance as well by means of the degree of opening of the control part 1. Thus electric monitoring of the onset and end of feeding to an injection system is available. With the embodiment proposed according to the invention for a 2/2-way valve with longer stroke travel paths for large diesel engine applications, the switching times can be shortened drastically, and the injection quantities can be metered with extreme accuracy at the injection nozzle.

The foregoing relates to preferred exemplary embodiment of the invention, it being understood that other variants and embodiments thereof are possible within the spirit and scope of the invention, the latter being defined by the appended claims.

What is claimed is:

1. A control unit for an injection system for fuel, comprising a control part (1) which is movable between a valve seat (6) and a stop face (7) of a bore (32) in a housing (29), a high-pressure line (25) which discharges into the bore (32) that penetrates the housing (29) and receives the control part (1), and a control face (28) of the control part (1) opposite the valve seat (6) acting in the higher rpm range as a throttle element for filling the pump chamber (9), the motion of said control part (1) is reinforced by two energy accumulators (4, 5) assigned to actuating devices (2, 3) of the control part (1), said control part (1) is provided with a closing body (13) and a cylinder (14) and wherein the diameter (13.1) of the closing body (13) is dimensioned so as to be greater than the diameter (14.1) of the cylinder (14).

2. The control unit for an injection system of claim 1, wherein said control part (1) is moved in the housing (29) by two triggerable actuating devices (2, 3).

3. The control unit for an injection system of claim 2, wherein said actuating devices (2, 3) are individually triggerable via a control unit (12).

4. The control unit for an injection system of claim 1, wherein said high-pressure line (25) discharges into a suction chamber (10) annularly surrounding the control part (1).

5. The control unit for an injection system of claim 1, wherein the energy accumulators (4, 5) act on the end faces of the closing body (13) and cylinder (14).

6. The control unit for an injection system of claim 1, wherein said control face (28) of the control part (1) is embodied with a cross section that decreases in the closing direction.

7. The control unit for an injection system of claim 1 wherein said control part (1) is provided with a through bore (33) which penetrates it and which communicates via openings (34, 35) with hollow chambers (21), surrounding the energy accumulators (4, 5), of the bore (32).

8. The control unit for an injection system of claim 7, wherein one of the hollow chambers (21) of the bore (32) that receive the energy accumulators (4, 5) communicates with a return line (22) into a tank (23).

* * * * *